US012209383B2

(12) United States Patent
Time

(10) Patent No.: US 12,209,383 B2
(45) Date of Patent: Jan. 28, 2025

(54) TORQUE ELEMENT FOR ABSORBING SHEAR FORCES IN A BOLT CONNECTION IN A BUCKET ELEMENT IN A LOADING MACHINE BUCKET

(71) Applicant: Hensley Industries Inc., Dallas, TX (US)

(72) Inventor: Eyvind Time, Bryne (NO)

(73) Assignee: Hensley Industries, Inc., Dallas, TX (US)

( * ) Notice: Subject to any disclaimer, the term of this patent is extended or adjusted under 35 U.S.C. 154(b) by 334 days.

(21) Appl. No.: 17/618,303

(22) PCT Filed: Jun. 11, 2020

(86) PCT No.: PCT/NO2020/050153

§ 371 (c)(1),
(2) Date: Dec. 10, 2021

(87) PCT Pub. No.: WO2020/251369

PCT Pub. Date: Dec. 17, 2020

(65) Prior Publication Data

US 2022/0307221 A1 Sep. 29, 2022

(30) Foreign Application Priority Data

Jun. 11, 2019 (NO) ..... 20190714

(51) Int. Cl.

| | |
|---|---|
| ***E02F 3/40*** | (2006.01) |
| ***E02F 3/815*** | (2006.01) |
| ***E02F 9/28*** | (2006.01) |

(52) U.S. Cl.

CPC ..... *E02F 3/40* (2013.01); *E02F 3/815* (2013.01); *E02F 9/2883* (2013.01); *E02F 9/28* (2013.01)

(58) Field of Classification Search

CPC ..... E02F 3/40; E02F 3/14; E02F 3/141; E02F 3/142; E02F 3/815; E02F 3/8152;
(Continued)

(56) References Cited

U.S. PATENT DOCUMENTS

| | | | |
|---|---|---|---|
| 1,539,863 | A | 6/1925 | Edward |
| 3,994,084 | A | 11/1976 | Smith et al. |

(Continued)

FOREIGN PATENT DOCUMENTS

| | | | |
|---|---|---|---|
| AU | 2015223429 | A1 | 9/2016 |
| CN | 105155608 | | 12/2015 |

(Continued)

OTHER PUBLICATIONS

Norwegian Search Report for No. 20190714, dated Jan. 13, 2020.

(Continued)

*Primary Examiner* — Jamie L McGowan
*Assistant Examiner* — Audrey L Lusk
(74) *Attorney, Agent, or Firm* — Haynes and Boone, LLP

(57) ABSTRACT

A bucket portion is for a loading-machine bucket and has at least two bucket elements. One of the bucket elements has a cut-out. The bucket portion also has a torque element for absorbing shear forces in a screw connection, the torque element having a first side and an elevation protruding from the first side. The elevation has a base contour and a smaller top contour. A sloping face is between the base contour and the top contour. The elevation has a height axis which is perpendicular to the base contour. The elevation is positioned in a cut-out in the bucket element and receives the screw connection for the torque element to be attached to the bucket element. The torque element or the bucket element has an internally threaded portion for the screw connection, and connects a first respective bucket element with a second respective bucket element.

14 Claims, 11 Drawing Sheets

(58) Field of Classification Search
CPC ..... E02F 9/2883; E02F 9/2833; E02F 9/2858; E02F 9/2808; E02F 9/2816; E01H 5/061; E01H 5/063; E01H 5/066
USPC ..... 37/456
See application file for complete search history.

(56) References Cited

U.S. PATENT DOCUMENTS

| | | | | |
|---|---|---|---|---|
| 4,180,926 | A | 1/1980 | Klett et al. | |
| 6,194,080 | B1 * | 2/2001 | Stickling | E02F 9/2841 428/596 |
| 2003/0066215 | A1 * | 4/2003 | Grant | E02F 9/2883 37/446 |
| 2013/0025171 | A1 * | 1/2013 | Torgrimsen | E02F 9/2883 37/444 |
| 2013/0145659 | A1 * | 6/2013 | LaHood | E02F 9/2883 37/453 |
| 2015/0247306 | A1 * | 9/2015 | Kunz | E02F 9/2833 37/455 |
| 2017/0089045 | A1 | 3/2017 | Dare | |

FOREIGN PATENT DOCUMENTS

| | | | |
|---|---|---|---|
| FR | 1586739 | * | 2/1970 |
| JP | S5286905 | | 6/1977 |
| NO | 333294 | | 4/2013 |
| NO | 343948 | | 7/2019 |
| NO | 20171975 | | 7/2019 |

OTHER PUBLICATIONS

International Search Report and the Written Opinion for PCT/NO2020/050153, dated Aug. 26, 2020.
Extended European Search Report, Application No. 20821623.4-1002/3994314 PCT/NO2020050153, dated Jul. 21, 2003, 4 pages.

* cited by examiner

TORQUE ELEMENT FOR ABSORBING SHEAR FORCES IN A BOLT CONNECTION IN A BUCKET ELEMENT IN A LOADING MACHINE BUCKET

CROSS-REFERENCE TO RELATED APPLICATIONS

This application is the U.S. national stage application of International Application PCT/NO2020/050153, filed Jun. 11, 2020, which international application was published on Dec. 17, 2020, as International Publication WO 2020/251369 in the English language. The International Application claims priority of Norwegian Patent Application No. 20190714, filed Jun. 11, 2019. The international application and Norwegian application are both incorporated herein by reference, in entirety.

FIELD OF THE INVENTION

The invention relates to a bucket portion for a loading-machine bucket, wherein the bucket portion comprises at least two bucket elements, wherein at least one of the bucket elements comprises a cut-out, and wherein the bucket portion further comprises at least one torque element for absorbing shear forces in a screw connection. The invention also relates to torque element as part of such bucket portion.

BACKGROUND OF THE INVENTION

By a loading-machine bucket is meant, in this connection, any form of bucket for digging or loading, for example an excavator bucket or a wheel loader bucket. The bucket in this connection typically has a width of between one and six metres.

A bucket is subjected to considerable wear and is therefore usually provided with replaceable wearing parts. A front piece is an example of a wearing part for a bucket. Even if the front piece may be provided with wearing strips or similar protective elements that are designed to extend the life of the front piece, it is necessary, at varying intervals, to carry out replacement of the front piece.

The front piece has a top side, a bottom side, a front portion and a rear abutment face. In a fully assembled bucket, the rear abutment face of the front piece abuts against a corresponding, front abutment face belonging to a bucket body, also known as a bucket bottom. It is known to weld the front piece to the bucket body along the rear abutment face. An alternative method of attachment is screwing the wearing part, the front piece in this example, to a coupling plate which has been welded to the bottom side of the bucket body, and which extends forwards from the front abutment face of the bucket body.

The applicant's own unpublished patent document NO20171975 discloses an attachment for a bucket front on a digging bucket, in which side elements form coupling portions for the bucket front, and in which several first cut-outs extend into the side element, and a bolt hole extends through the coupling portion transversely to the longitudinal direction of said cut-outs, and in which the bucket front is provided with several through second cut-outs for receiving coupling pins which are arranged to extend through the bucket front and into the cut-outs of the side elements, the coupling pins being provided with projecting first end portions and second end portions provided with transverse bolt holes, and the bolt holes of the coupling pins, when the bucket front is abutting against the side elements and the coupling pins have been inserted through the bucket front into the cut-outs of the side elements, being in line with the bolt holes through the coupling portions of the side elements to be able thereby to receive respective attachment bolts.

When a bucket is being filled with a mass, for example crushed rock, the weight of the mass will typically give the bucket front a deflection, the deflection increasing with the width of the bucket and being largest in wide wheel loader buckets. Said coupling pins are subjected to a great torque and great spot loads in a lower portion of the coupling pins, the coupling pins forming a rigid connection between the bucket front and the side element. Over time, there is therefore a risk of the bolt suffering fatigue failure.

The invention has for its object to remedy or to reduce at least one of the drawbacks of the prior art or at least provide a useful alternative to the prior art.

The object is achieved through the features that are specified in the description below and in the claims that follow.

SUMMARY OF THE INVENTION

The invention is defined by the independent claims. The dependent claims define advantageous embodiments of the invention.

In a first aspect, the invention relates more specifically to a bucket portion in accordance with claim 1.

By a bucket element may be understood an element which forms part of a bucket portion. The bucket portion may comprise a plurality of bucket elements that are attached to each other by the use of welds or screw connections. The torque element may be part of the bucket element. In one embodiment, the bucket element may be a front piece which is screwed to an underlying bucket element or bucket body. In another embodiment, the bucket element may be a bucket element that is screwed to an overlying bucket element.

By a screw connection may be understood, herein, any connection which is arranged to hold the elevation and the cut-out together. The screw connection may advantageously have a preload.

The cut-out has a base contour which corresponds to the base contour of the torque element, and a bottom contour corresponds to the top contour of the torque element. Herein, by corresponding, adapted may be understood. Two corresponding contours may be of different sizes.

The screw connection described herein is typically used to attach bucket elements together in a loading machine bucket, the bucket elements usually being arranged in a layered manner in the loading machine bucket. The loading machine bucket may comprise a plurality of like and different bucket elements. The bucket element may be elongated.

When the bucket element is subjected to a force component that is directed radially at the screw connection, the sloping faces of the elevation and cut-out will absorb the radial forces so that the screw connection is only subjected to an axial force. By the screw connection being subjected to small or no radial shear forces, a screw connection of a smaller dimension may be used, compared to the prior art where the screw connection is arranged to absorb a radial shear force. By the fact that smaller screws can be used, smaller and simpler tools may be used for tightening and loosening the screws and the nuts, if any, in the screw connection.

The loading machine may be a wheel loader, an excavator or any machine arranged for digging or moving masses. During loading, the loading machine bucket is moved along a working direction of the loading machine and on a surface into a heap of unconsolidated masses. The surface may be a firm ground, for example rock. The unconsolidated masses may be unconsolidated masses existing naturally or blasted rock, gravel or sand. The centre axis of the screw connection is normally arranged perpendicularly to the working direction of the bucket, so that the screw connection is subjected to shear forces when the bucket is moved along the ground or into the unconsolidated mass, and especially if the wearing part encounters great resistance.

The effect of the torque element described herein is that when the torque element is subjected to a force component in the working direction of the bucket, as described above, the torque element will be pushed upwards along the sloping face so that the screw connection is loaded in its axial direction and subjected to shear forces to a small or no extent.

By the screw connection being perpendicular at the centre of the elevation, the screw connection may be subjected to a tensioning independent of the magnitude and direction of the force component.

The height axis may be a centre axis. The centre axis may be arranged in a centre plane formed in an elongated torque element, for example a rectangle or an oval.

The bucket element may be a bucket body.

By a bucket body is meant, herein, a bucket element which is formed of a tough material with great rupture strength, and which is arranged to absorb tensions in the bucket portion and thereby reduce the risk of fracture. A tough material normally has little wear strength. The bucket body may be arranged to be a tying element for a plurality of other elements.

The bucket element may be a wearing part.

By a wearing part is meant, herein, a bucket element which is subjected to wear in normal use and which will have to be replaced at regular intervals. The wearing part described herein may be arranged to protect a bucket body and may be positioned in front of a bucket body, on the side of a bucket body or under a bucket body. The wearing part may enclose a portion of a bucket body. A front piece and teeth are examples of wearing parts.

By providing a loading machine bucket with bucket bodies of great rupture strength and wearing parts of great hardness, the loading machine bucket may absorb great loads and have great wearing strength.

The torque element may comprise at least two elevations, the at least two elevations being arranged to engage with corresponding cut-outs in a first bucket element and a second bucket element, respectively.

The effect of the at least two elevations is that the torque element can connect two or more bucket elements. The first bucket element may be a bucket body or a wearing part. The second one of the bucket elements may be a bucket body or a wearing part.

The first and second bucket elements may be positioned in the same plane, wherein two or more bucket elements are arranged side by side, thereby forming a plane surface, or in several planes. The torque element may abut against a top side belonging to the first bucket element and a top side belonging to the second bucket element. The torque element may abut against a bottom side belonging to the first bucket element and a bottom side belonging to the second bucket element.

When the torque element connects two bucket elements and one bucket element is subjected to a force component directed radially at the screw connection, the sloping faces of the elevation and cut-out will absorb the radial forces so that the screw connection is only subjected to an axial force.

The screw connection being subjected to small or no radial shear forces, a screw connection of a smaller dimension may be used, compared to the prior art in which the screw connection is arranged to absorb a radial shear force. By the fact that smaller screws can be used, smaller and simpler tools may be used for tightening and loosening the screws and the nuts, if any, in the screw connection.

The base contour and the bottom contour may be identical in shape. The base contour and the bottom contour may be different in shape. If the base contour is circular, a conically shaped sloping face may be formed. If the base contour is square, four congruous sloping faces may be formed, which are positioned symmetrically around the centre axis. If the base contour is rectangular, four sloping faces of two shapes may be formed, two opposite faces being arranged symmetrically around the centre axis or the centre plane.

In an advantageous embodiment, the elevations are arranged symmetrically, so that the coupling element may be turned if a side edge of the coupling element suffers extensive wear.

The sloping faces of the elevation and cut-out may advantageously have an angle of between 40 and 45 degrees to the base contour. A gentler angle may result in the torque element being allowed to be pushed more easily up along the sloping face, so that the screw connection gets a higher axial load. A gentler angle may result in a greater force being required for the torque element to be pushed up along the sloping face, so that the screw connection gets a smaller axial load.

The torque element may be part of an element arranged to abut against a bucket body. The torque element may be part of an element arranged to abut against a side element.

The torque element may comprise a recess for housing a nut or a head belonging to the screw connection. The effect of the recess is that the nut or head is protected against wear.

The at least one sloping face of the torque element may have a gentler angle than a corresponding sloping face formed between a base contour and a bottom contour of the cut-out, so that a defined contact surface, and thereby a locking contact surface, is provided between the elevation and the recess.

The effect of the defined and locking contact surface is that a contact surface with a great surface pressure is created between the torque element and the cut-out. A great surface pressure may give a better and more locking engagement between the torque element and the recess, compared with a large contact surface with a low surface pressure. A large contact surface with little surface pressure is achieved when the corresponding sloping faces have equal angles.

Calculations and trials carried out by the applicant show that the desired surface pressure and locking effect can be achieved when the sloping face of the recess has an angle that is between 0.5 and 1.5 degrees gentler than that of the corresponding sloping face of the cut-out. The angular difference between them may be smaller than 0.5 degrees. The angular difference between them may be larger than 1.5 degrees.

A clearance may be formed between the top face of the elevation and the bottom contour of the cut-out when the elevation is positioned in the cut-out.

The effect of the clearance is that a preload may be provided between the torque element and the bucket element, the preload providing an elastic extension of the screw to secure the screw against loosening and fatiguing.

The torque element may be plate-shaped.

The effect of the plate-shaped torque element is that the torque element can be installed inside a loading machine bucket without being an obstacle to the mass that is to be filled into the loading machine bucket. A plate-shaped torque element may also be fitted to the bottom side of the loading machine bucket.

The plate-shaped torque element may comprise an external bevel. The effect of the external bevel is that the mass can slide more easily over the torque element than when the external edge is perpendicular to the surface of the torque element.

The torque element may be a wearing part.

The effect of the torque element being a wearing part is that the torque element may be installed in places of extensive wear. In one embodiment, the torque element may be a wear-resistant steel element for a bottom side of a loading machine bucket. In a second embodiment, the torque element may be a front piece for a loading machine bucket. In a third embodiment, the torque element may be a side element in a loading machine bucket.

In a second aspect, the invention relates to a system for attaching a bucket element in a bucket portion for a loading machine bucket, the system comprising at least one torque element according to the first aspect of the invention for attaching two bucket elements to each other, and at least one coupling element for connecting a bucket element and a side element in a bucket portion for a loading machine bucket.

The side element is arranged to abut against a top side belonging to the bucket element. The bucket element has a bottom side with an elongated recess with a centre axis. The elongated recess surrounds a through cut-out that extends to the top side of the bucket element. The coupling element comprises an elongated body arranged to lie pivotably supporting against the recess so that the bucket element can pivot around the elongated body, and a neck for attaching to the side element, the neck projecting from the elongated body.

The effect of the system that is described herein is that the torque element and the coupling element may simplify the installing and replacing of wearing parts in a bucket, as there is no need to connect the parts by welding, and separate the parts by using grinding tools. Further, the torque element and the coupling element may eliminate or at least reduce tensions and shear forces that may arise between adjacent parts in a bucket that has been connected in accordance with the prior art.

The design of the torque element and the design of the coupling element also reduce the need for heavy duty special tools, as the screw connection used herein has a considerably smaller dimension than is the case in the prior art.

BRIEF DESCRIPTION OF THE DRAWINGS

In what follows, examples of preferred embodiments are described, which are visualized in the accompanying drawings, in which.

DETAILED DESCRIPTION OF THE DRAWINGS

Figure 1A:
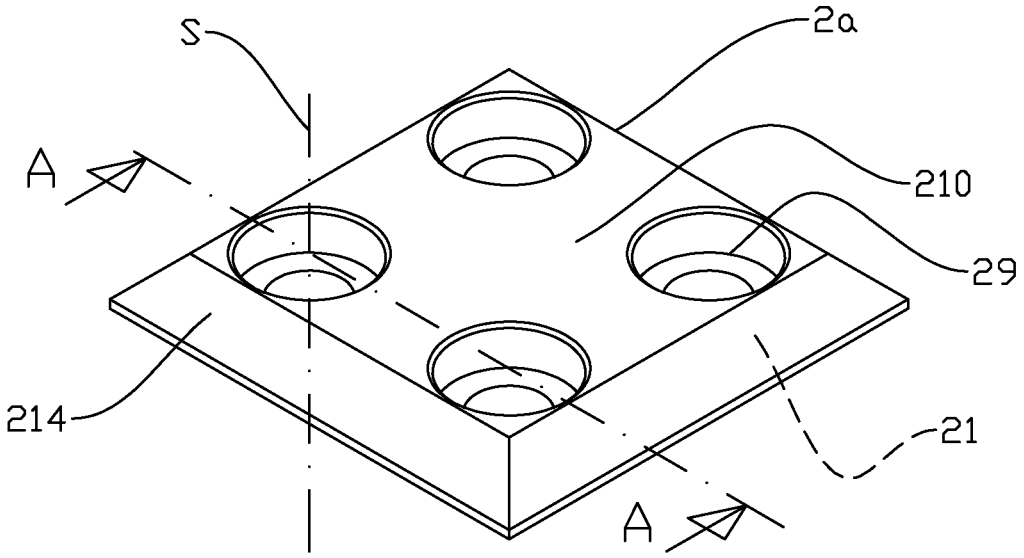
FIG. 1*a* shows, in perspective and from above, one embodiment of a torque element.
Figure 1B:
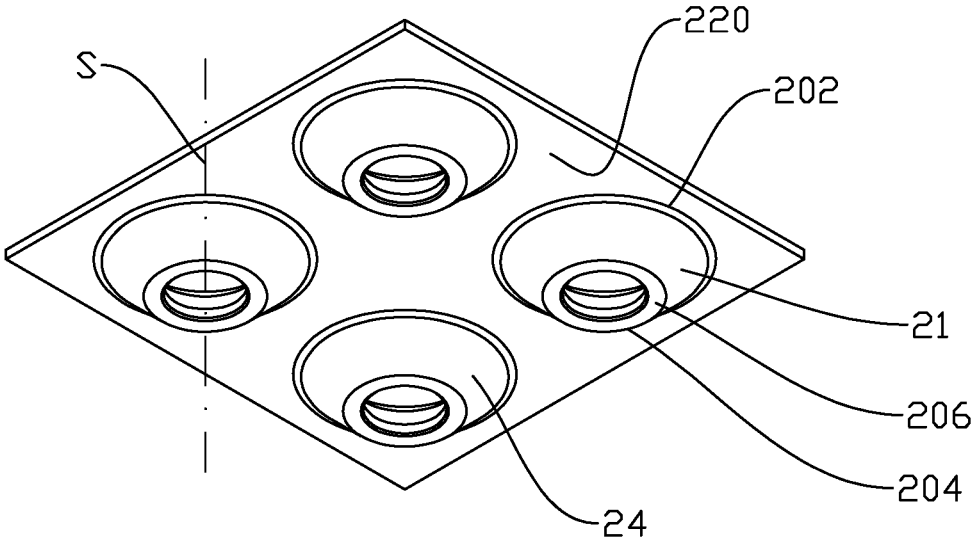
FIG. 1*b* shows the torque element of FIG. 1*a* from underneath.
Figure 1C:
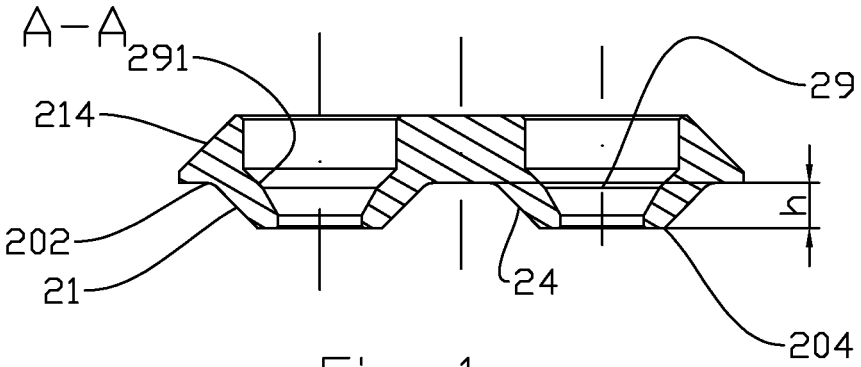
FIG. 1*c* shows a section through the torque element of FIGS. 1*a* and 1*b;*

FIGS. 1*a*, 1*b* and 1*c* show a first embodiment of a torque element 2*a* for absorbing shear forces in a screw connection 9 (FIGS. 5, 8*a*, 8*b*) arranged to attach a bucket element 40, 50 in a bucket portion 1 for a loading machine bucket. The torque element 2*a* comprises a first face 220, a second face 210, and a side face 214. Protruding from the first face 220, there is an elevation 21 with a height h, a base contour 202 and a smaller top contour 204 so that, between the base contour 202 and the top contour 204, a sloping face 24 is provided. The elevation 21 has a height axis S at a centre of the elevation 21, the height axis S being perpendicular to the base contour 202 and the first face 220. In the embodiment shown, the height axis S coincides with a centre axis of the elevation 21. The elevation 21 in FIGS. 1*a*-1*c* 21 is shown as a truncated cone, the contours 202, 204 being circular. The top contour 204 surrounds a top face 206 which is parallel to the first face 220. A through cut-out 29 is arranged to house a screw connection 9, shown in FIGS. 8*a* and 8*b*. The cut-out 29 includes a conical portion 291.

The torque element 2*a* is shown with a square plate shape and four elevations 21 which are positioned symmetrically relative to each other. The torque element 2*a* is further shown with sloping side faces 214.

Figure 2A:
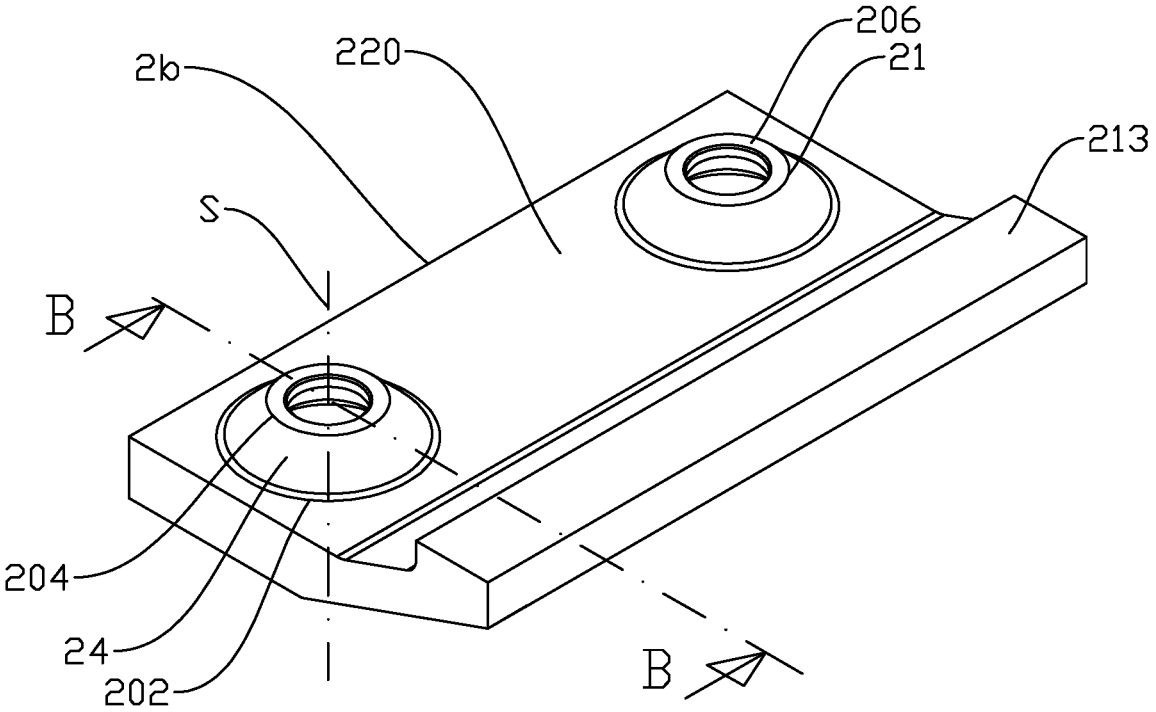
FIG. 2*a* shows, in perspective and from above, a second embodiment of the torque element.
Figure 2B:
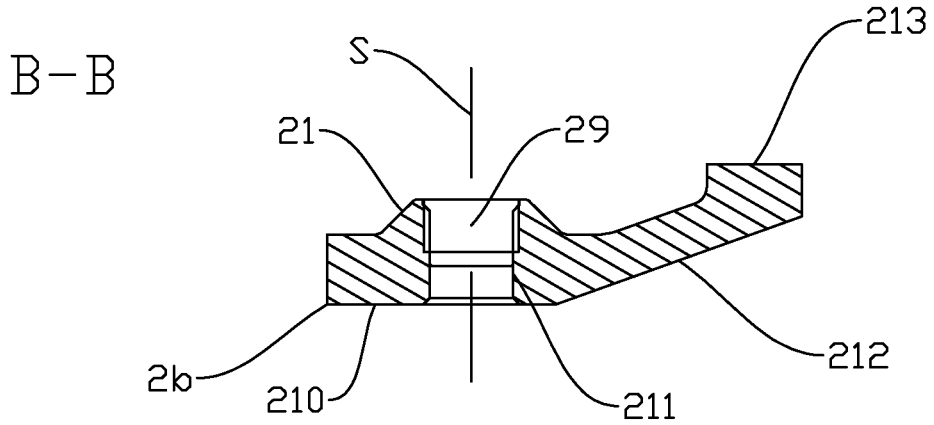
FIG. 2*b* shows a section through the torque element of FIG. 2*a;*
Figure 7:
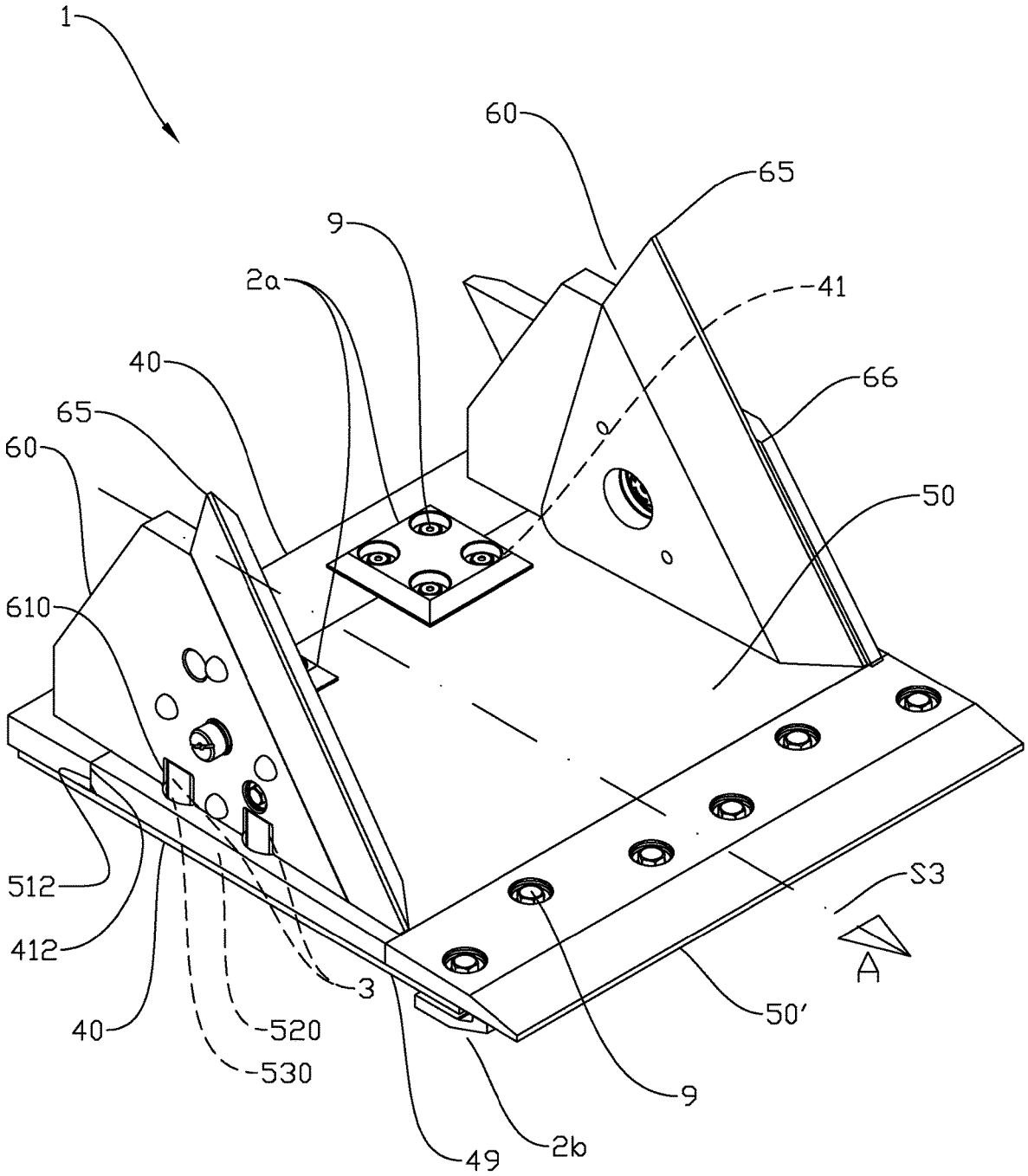
FIG. 7 shows, in perspective, a bucket portion comprising the first and second embodiments of the torque element.

FIGS. 2*a* and 2*b* show a second embodiment of the torque element 2*b*. The torque element 2*b* is shown here as an elongated body with a sloping portion 212 which is arranged to slide on a firm surface, for example during loading by the use of a wheel-loader. The torque element 2*b* further comprises an abutment face 213 arranged to abut supporting against a bucket body or a wearing part. The torque element 2*b* shown in FIGS. 2*a* and 2*b* is often positioned on the bottom side of a bucket, as shown in FIG. 7. The torque element 2*b* may be longer than, and include more elevations 21 than, what is shown in FIG. 2*a*.

The second embodiment 2*b* is shown with an internally threaded portion 211 which is arranged to receive a screw.

Figure 3A:
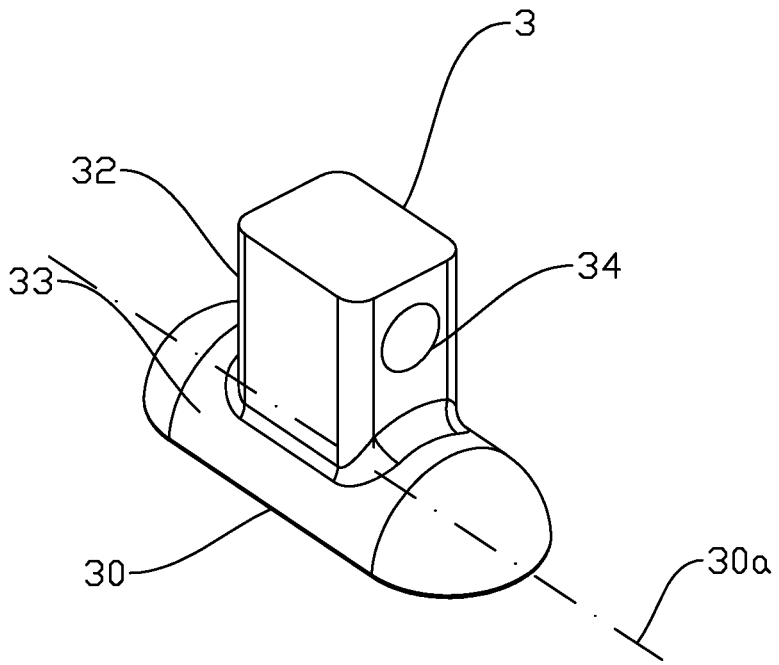
FIG. 3*a* shows a coupling element in perspective.
Figure 3B:
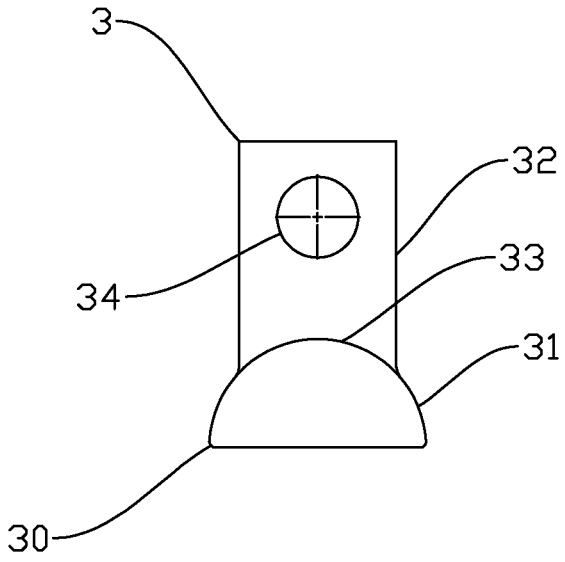
FIG. 3*b* shows a section of the coupling element of FIG. 3*a;*

FIGS. 3*a* and 3*b* show a coupling element 3 between a bucket element 50 and a side element 60 in a bucket portion 1 (FIGS. 4, 5, 6, 10*a* and 10*b*) for a loading machine bucket. The coupling element is not part of the invention described herein but has been included to illustrate the components of the system according to the second aspect of the invention.

The coupling element 3 comprises an elongated body 30 with a longitudinal axis 30*a*, and a neck 32 projecting up from the elongated body 30. The elongated body 30 is shown with a semicircular surface 33. The neck 32 is positioned at a centre of the elongated body 30 and is shown with a cross section which is smaller than the cross section of the elongated body 30. The neck 32 includes a through cut-out 34 arranged to receive a fastening element 650, shown as a bolt in FIG. 9.

Figure 4:
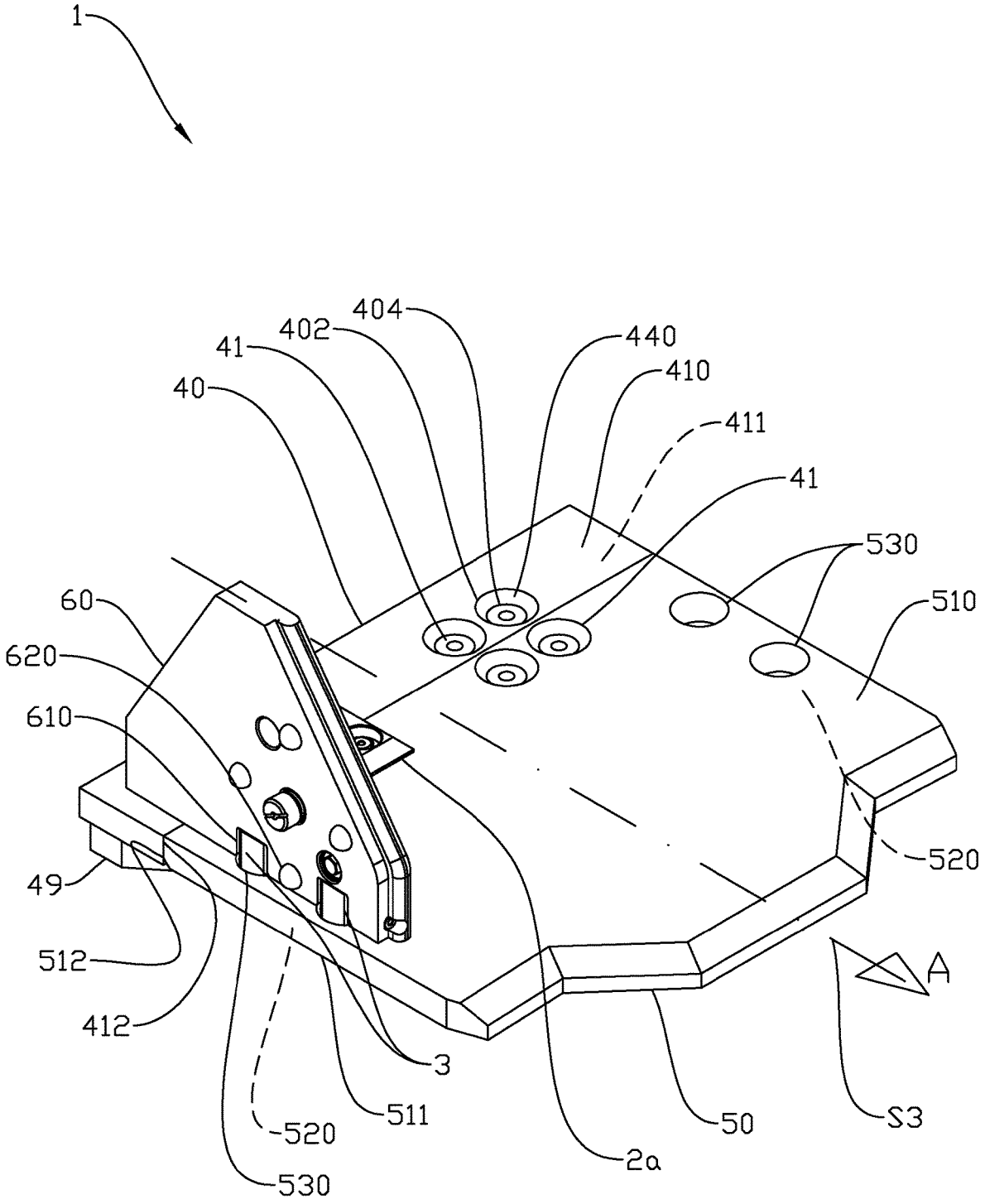
FIG. 4 shows, in perspective and on a smaller scale, a simplified drawing of a bucket portion for a loading-machine bucket, with a torque element and a coupling element.
Figure 5:
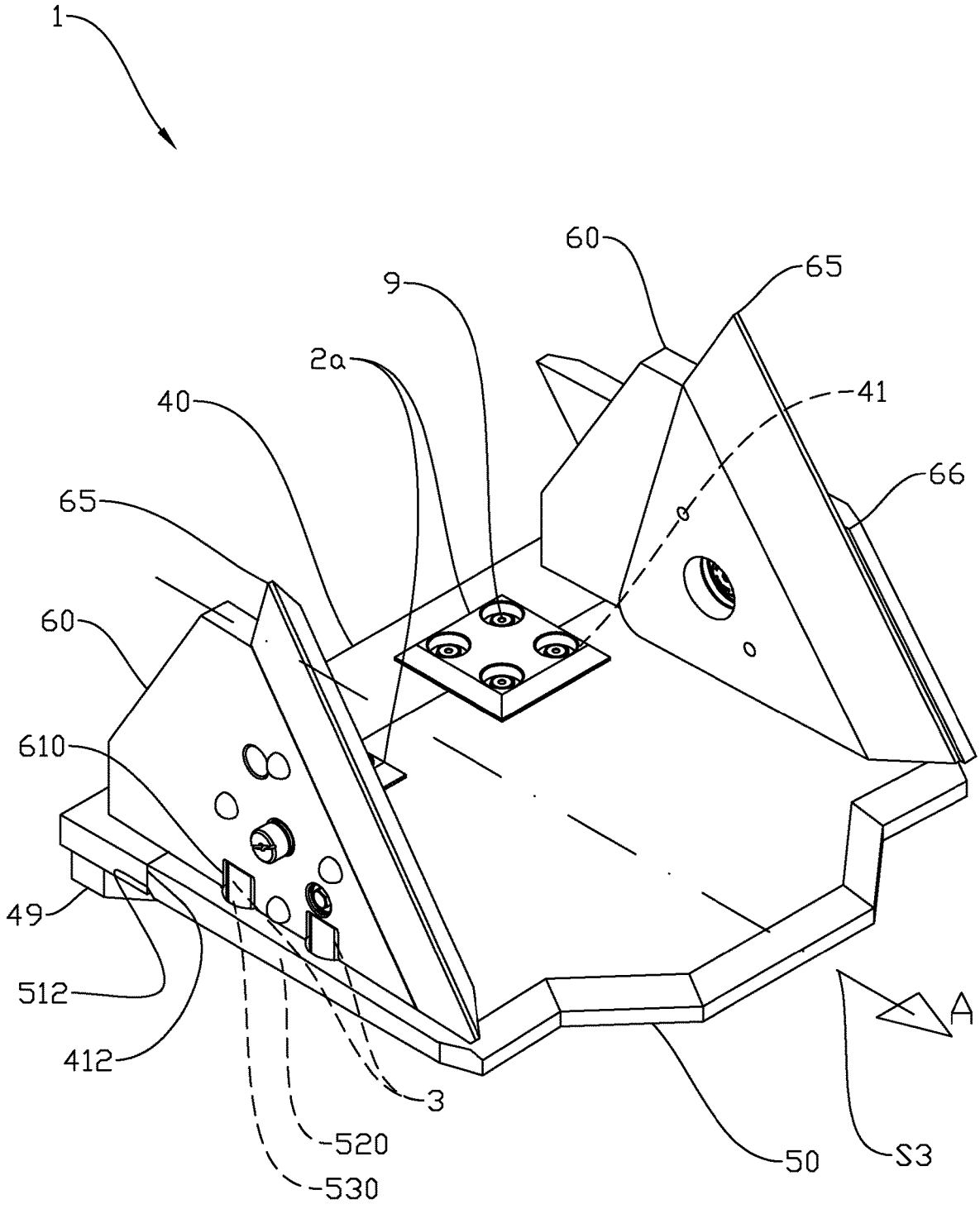
FIG. 5 shows the bucket portion of FIG. 4 with several bucket elements.
Figure 6:
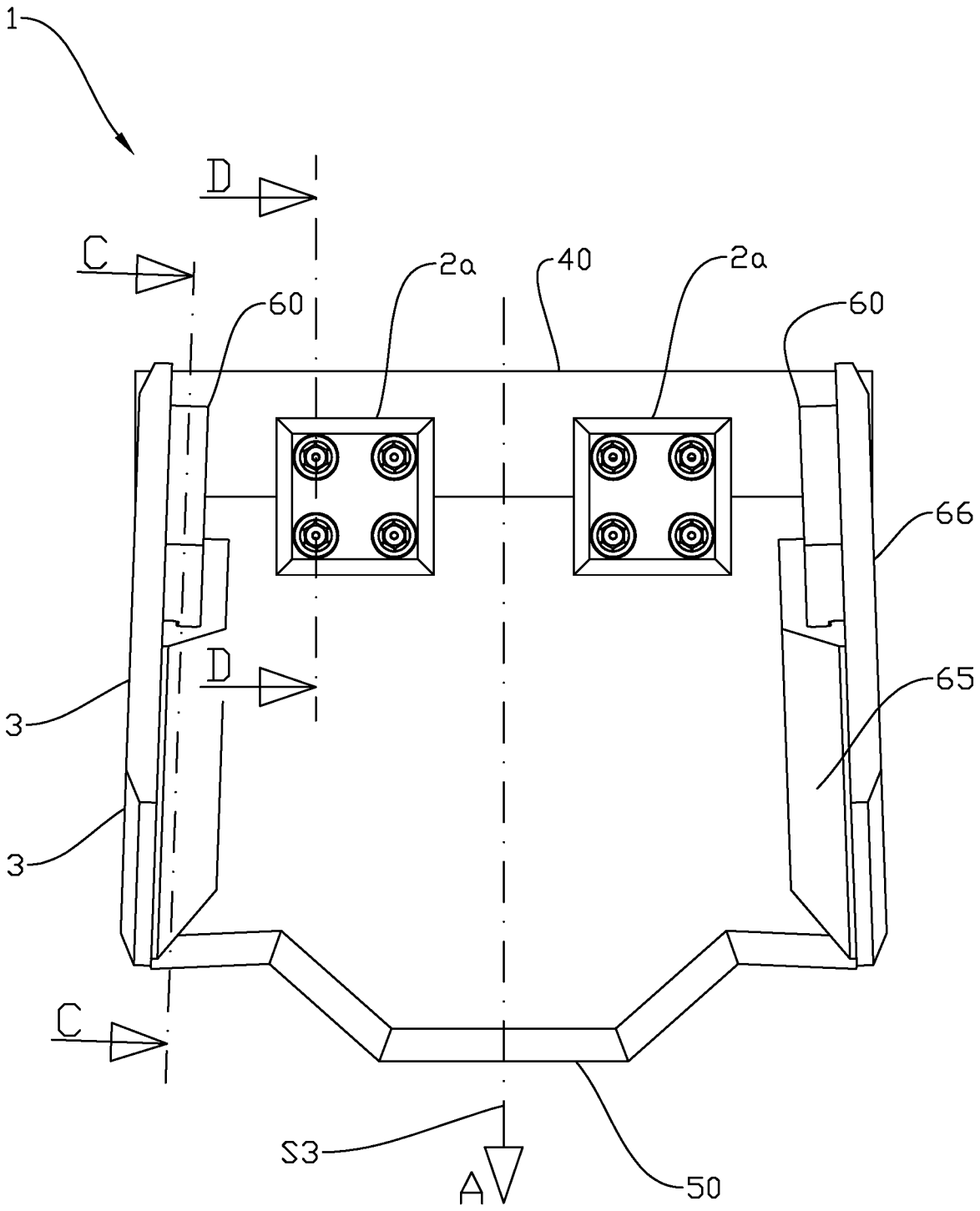
FIG. 6 shows FIG. 5, viewed from above.

FIGS. 4, 5 and 6 show the torque element 2*a* and the coupling element 3 installed in the bucket portion 1, the bucket portion 1 comprising a first bucket element 40 shown as a bucket bottom 40, and a second bucket element 50 shown as a wearing part, and a side element 60 with a front protection 65 and an outer wear face 66. In what follows, the first bucket element 40 will be referred to as a bucket bottom. In what follows, the second bucket element 50 will be referred to as a wearing part. Some elements have been removed from FIGS. 4 and 5 for easier illustration of the invention.

The bucket portion 1 has a centre axis S3 which coincides with a working direction A. By a working direction may be understood a direction of motion of the bucket portion 1 when the loading machine bucket is to be filled. During loading, the bucket portion 1 is moved into a mass in the working direction A and the bucket portion 1 is subjected to a force component along the centre axis S3. During loading, the bucket portion 1 may be in a plane position or in a slanted position.

The bucket bottom 40 has a top side 410, a bottom side 411 and a front abutment face 412. The top side 410 of the bucket bottom 40 includes cut-outs 41 arranged to receive elevations 21 belonging to a torque element 2*a*.

The wearing part 50 has a top side 510 and a rear abutment face 512 abutting against the front abutment face 412 of the bucket body. The top side 510 of the wearing part 50 includes cut-outs 41 arranged to receive elevations 21 belonging to the torque element 2*a*.

The wearing part 50 has a bottom side 511 with an elongated recess 520 (FIG. 9) with a centre axis which is parallel to the side element 60. The elongated recess 520 surrounds a through cut-out 530 which extends to the top side 510 of the wearing part 50.

The wearing part 50 and the bucket bottom 40 are releasably connected to each other by two torque elements 2*a*, each torque element comprising four screw connections 9. The torque elements 2*a* are shown as plate elements with a square base contour and four symmetrically positioned elevations 21 which engage with the corresponding cutouts 41 in the wearing part 50 and in the bucket bottom 40. The symmetrical design makes it possible to turn the torque elements 2*a* 90 or 180 degrees when worn.

The side element 60 abuts against the top side 510 of the wearing part 50 and the top side 410 of the bucket bottom 40. The elongated body 30 of the coupling element 3 is positioned in the elongated recess 520 of the wearing part 50, and the neck 32 extends through the through cut-out 530 in the wearing part 50 to the cut-out 610 of the side element 60. The coupling element 3 is releasably attached to the side element 60 via a fastening element 650, shown as a bolt in FIG. 9. The fastening element 650 is inserted into the side element via a cut-out 640 in the longitudinal direction of the side element.

FIG. 7 shows an alternative embodiment of the bucket portion 1, in which the bucket portion 1 is provided with a front bucket element 50', shown in the figure as a front wearing part 50'. The front wearing part 50' is connected to the bucket portion 1 with an underlying bucket body 49 and an elongated torque element 2*b*, shown in FIGS. 2*a* and 2*b*. A section of the connection is shown in FIG. 8*b*.

Figure 8A:
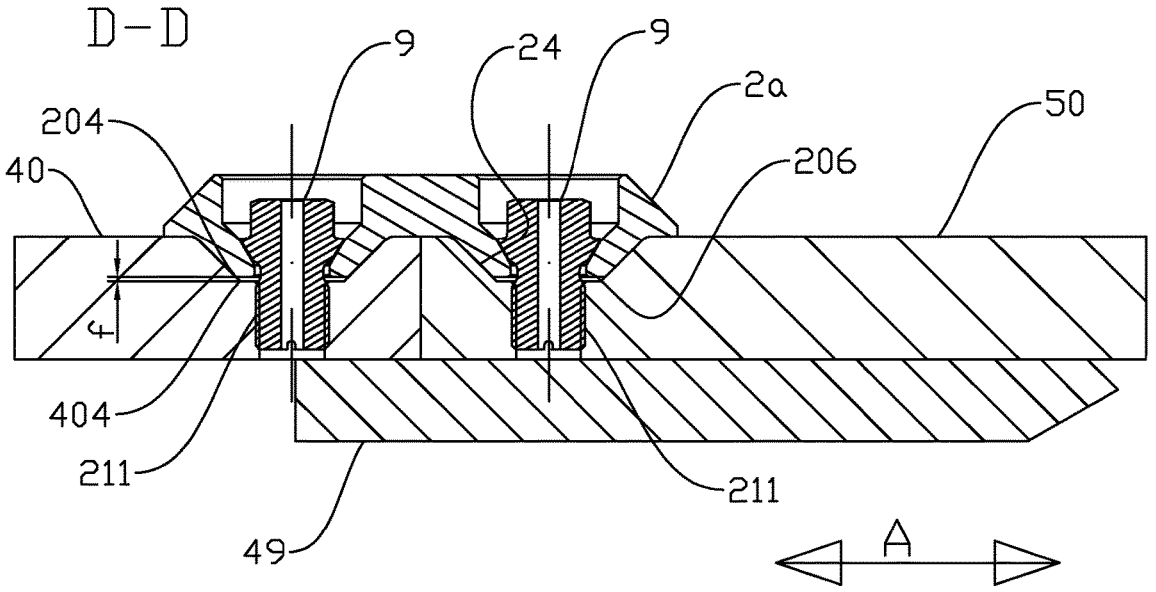
FIG. 8*a* shows, on a larger scale, a section of the first embodiment of the torque element installed in the bucket portion.

FIG. 8*a* shows a section D-D of the torque element 2*a* which is in engagement with the wearing part 50 and the bucket bottom 40. The torque element 2*a* is attached to the wearing part 50 and the bucket bottom 40 via two screw connections 9. The wearing part 50 and the bucket bottom 40 are provided with threaded portions 211 for the screw connections 9. An underlying bucket body 49 is welded to the bucket bottom 40 and is arranged to support the wearing part 50.

Figure 11:
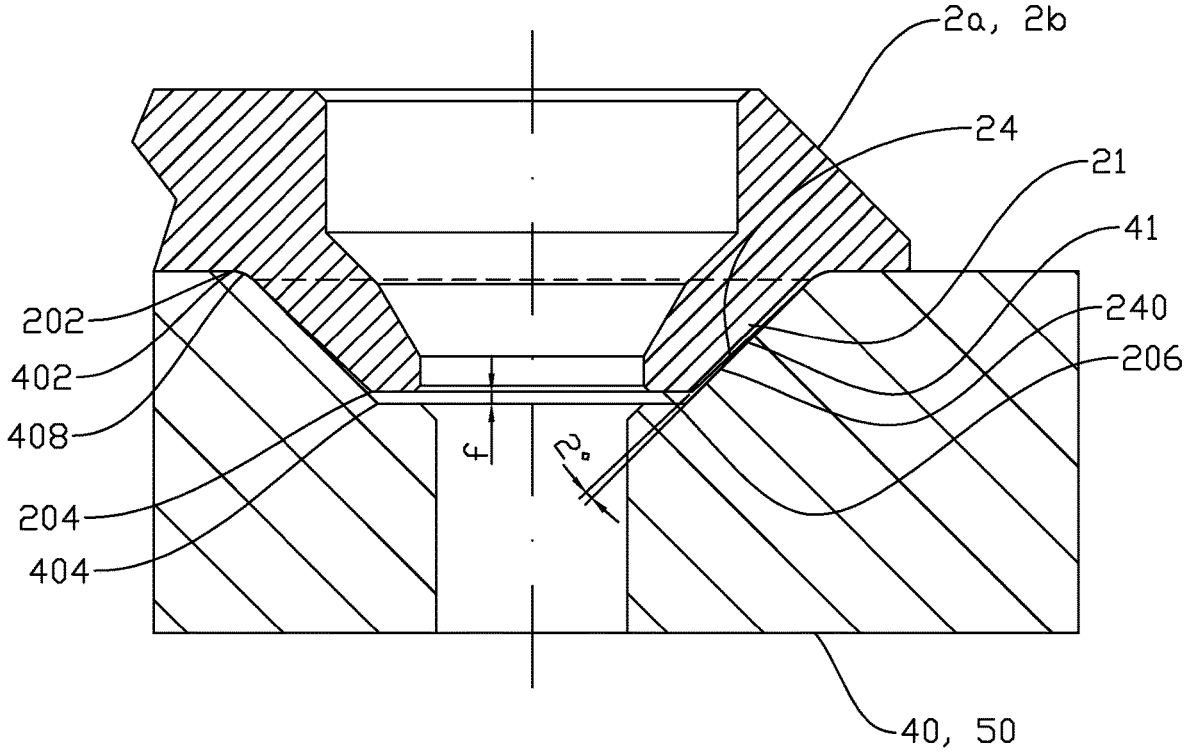
FIG. 11 shows a section of FIG. 8*a*.

When the wearing part 50 is subjected to a force component along the working direction A, an axial tensioning of the screw connections 9 will be created as the wearing part 50 will push the torque element 2*a* along the sloping face 24. FIG. 11 shows a section of the connection shown in FIG. 8*a*.

Figure 8B:
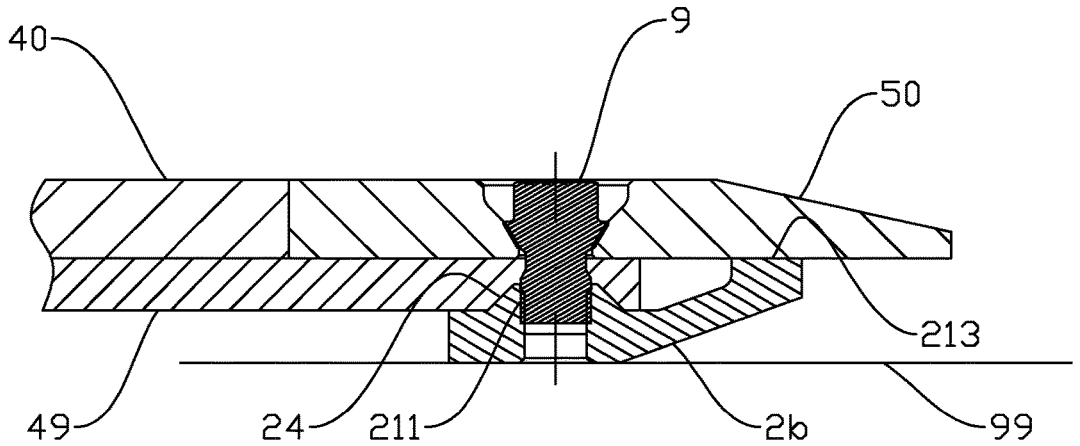
FIG. 8*b* shows, on a larger scale, a section of the second embodiment of the torque element installed in the bucket portion.

FIG. 8*b* shows a section of the torque element 2*b* which is in engagement with the wearing part 50 and the bucket bottom 40, shown in FIG. 7. The torque element 2*b* is attached to the wearing part 50 and the bucket bottom 40 via a plurality of screw connections 9. The torque element 2*b* is provided with an internally threaded portion 211 for the screw connection 9. Further, the torque element 2*a* is arranged to abut supporting against a firm surface 99. The technical effect of the coupling between the elevation 21 and the cut-out 41 is the same as in FIG. 8*a*.

Figure 9:
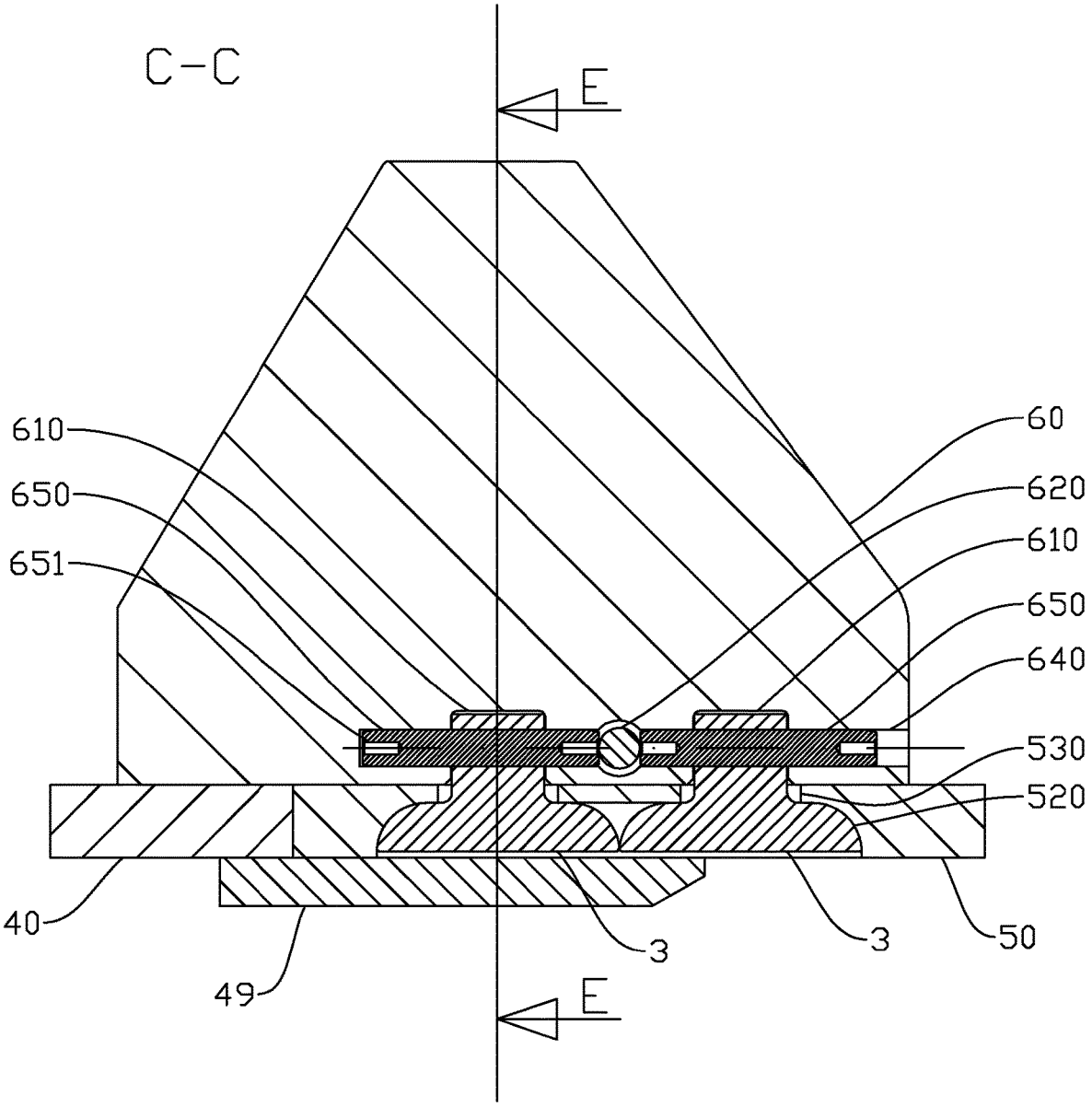
FIG. 9 shows a longitudinal section of the coupling element installed in the bucket portion.

FIG. 9 shows the coupling element 3 (FIG. 3) in a section C-C (FIG. 6). The coupling element 3 is arranged to reduce or remove a torque which may arise between the wearing part 50 and the side element 60 in a bucket portion 1 for a loading-machine bucket. The side element 60 abuts against a top side 510 belonging to the wearing part 50. The wearing part 50 has a bottom side with an elongated recess 520 housing a portion of the coupling element 3. The coupling element 3 is shown with an elongated body 30 and a neck 32 which is positioned at the centre on the elongated body 30. The neck 32 projects through a through cut-out 530 (FIG. 4) in the wearing part 50 and into a cut-out 610 in the side element 60.

The side element 60 has a cut-out 640 for receiving a fastening element 650 for the coupling element 3. In FIG. 9, two fastening elements 650 are shown, shown as bolts. The fastening elements 650 comprise internally threaded portions 651 arranged to receive an installation tool (not shown). The two fastening elements 650 are held in position by means of a coupling ball 620 (FIG. 4) and an end piece 65 (FIGS. 5-7).

Figure 10A:
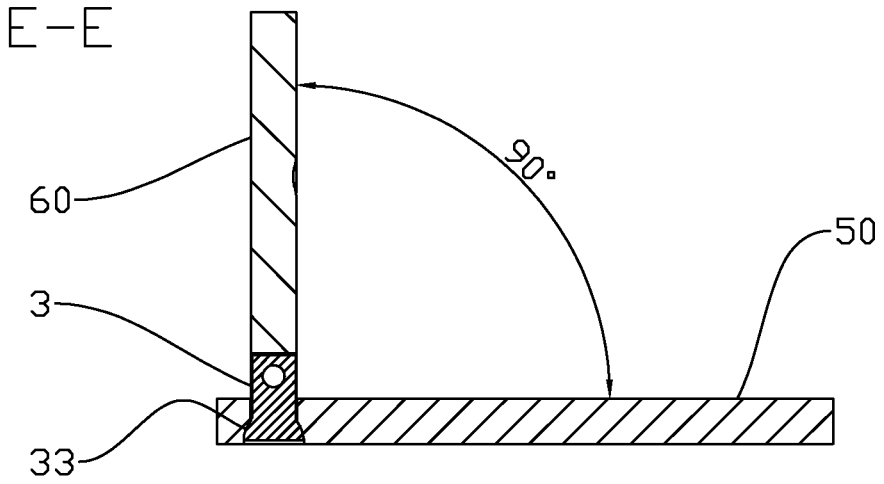
FIG. 10*a* shows a cross section of the coupling element in an unloaded loading-machine bucket.
Figure 10B:
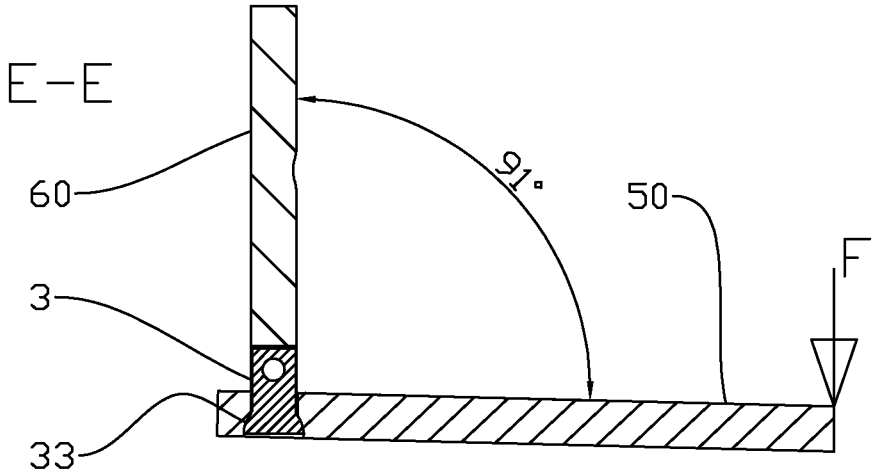
FIG. 10*b* shows a cross section of the coupling element in a loaded loading-machine bucket.

FIGS. 10*a* and 10*b* show the coupling element 3 in a section E-E (FIG. 9). The wearing part 50 abuts against the coupling element 3. In FIG. 10*a*, the wearing part 50 is unloaded, and the wearing part 50 is positioned perpendicularly to the side element 60.

In FIG. 10*b*, the wearing part 50 is loaded by a force F so that the wearing part is subjected to a deflection. When the wearing part 50 is being deflected, the wearing part 50 will pivot around a centre axis of the semicircular surface 33 on the coupling element 3. By the wearing part 50 being able to pivot around the coupling element 3, a moment and the shear forces that arise in a prior-art rigid coupling may be reduced or eliminated.

FIG. 11 shows the elevation 21 positioned in the cut-out 41, the sloping face 24 of the elevation being shown with a gentler angle than the corresponding sloping face 440 of the cut-out. A different angle as shown in FIG. 11 provides a defined contact surface, and thereby a locking contact surface, 408 with great surface pressure between the elevation 21 and the cut-out 41. When the elevation 21 and the cut-out 41 have the same shape, the contact surface 408 will be a surrounding one. In FIG. 11, an angular difference of two degrees is shown in order to illustrate the invention more easily.

Between the top face 206 of the elevation and the bottom contour 404 of the cut-out, a free space with a height f is created to ensure that the torque element 2*a*, 2*b* will be lying in a supporting abutment against the cut-out 41 along the contact surface 408.

It should be noted that all the above-mentioned embodiments illustrate the invention, but do not limit it, and persons skilled in the art may construct many alternative embodiments without departing from the scope of the attached claims. In the claims, reference numbers in brackets are not to be regarded as restrictive.

The use of the verb "to comprise" and its different forms does not exclude the presence of elements or steps that are not mentioned in the claims. The indefinite article "a" or "an" before an element does not exclude the presence of several such elements.

The fact that some features are indicated in mutually different dependent claims does not indicate that a combination of these features cannot be used with advantage.

The invention claimed is:

1. A bucket portion for a loading-machine bucket, wherein the bucket portion comprises at least two bucket elements disposed with portions adjacent each other in a lateral direction, wherein at least a first bucket element of the at least two bucket elements comprises a cut-out having at least one sloping face, and wherein the bucket portion further comprises at least one torque element for absorbing shear forces in a screw connection, wherein each torque element is disposed completely rearward of a leading edge of the bucket portion and is shaped as an elevation, wherein the elevation has a base contour and a smaller top contour so that between the base contour and the top contour, at least one sloping face is provided, wherein the elevation has a height axis at a center of the elevation, the height axis being perpendicular to the base contour, wherein the elevation is arranged for positioning in a corresponding cut-out in the first bucket element to engage with the first bucket element, wherein the elevation is arranged to receive the screw connection along the height axis for the torque element to be attached to the first bucket element, and wherein the screw connection is arranged to connect the first bucket element with a second respective bucket element of the at least two bucket elements via the torque element.

2. The bucket portion in accordance with claim 1, wherein the height axis is a center axis.

3. The bucket portion in accordance with claim 1, wherein at least one of the bucket elements is a bucket body.

4. The bucket portion in accordance with claim 1, wherein at least one of the bucket elements is a wearing part.

5. The bucket portion in accordance with claim 1, wherein the torque element comprises at least two elevations, the at least two elevations being arranged to engage with the corresponding cut-out in the first bucket element and a corresponding cut-out in the second bucket element, respectively.

6. The bucket portion in accordance with claim 1, wherein the at least one sloping face comprises at least a first sloping face and at least a second sloping face in the corresponding cut-out in the first bucket element, wherein the at least a second sloping face is formed between a base contour and a bottom contour of the cut-out, wherein the at least a first sloping face has a gentler angle than the at least a second sloping face, so that a defined contact surface, and thereby locking contact surface, is provided between the elevation and the cut-out.

7. The bucket portion in accordance with claim 1, wherein a clearance is formed between the top face of the elevation and a bottom contour of the cut-out when the elevation is positioned in the cut-out.

8. The bucket portion in accordance with claim 1, wherein the torque element is plate-shaped.

9. The bucket portion in accordance with claim 1, wherein the torque element is a wearing part.

10. The bucket portion according to claim 1, wherein the bucket body further comprises at least one coupling element for connecting a bucket element and a side element, wherein:

the side element is arranged to abut against a top side belonging to the bucket element;

the bucket element has a bottom side with an elongated recess with a center axis, wherein the elongated recess surrounds a through cut-out extending to the top side of the bucket element; and the coupling element comprises an elongated body arranged to lie pivotably supporting against the recess so that the bucket element can pivot around a portion of the elongated body, and a neck for attachment to the side element, the neck projecting from the elongated body.

11. The bucket portion according to claim 1, wherein the torque element is mounted to the bucket portion via a plurality of screw connections.

12. The bucket portion according to claim 1, wherein the torque element embodies the internally threaded portion.

13. The bucket portion in accordance with claim 2, wherein at least one of the bucket elements is a bucket body.

14. A bucket portion for a loading-machine bucket, wherein the bucket portion comprises at least two bucket elements, wherein at least a first bucket element of the at least two bucket elements comprises a cut-out, and wherein the bucket portion further comprises at least one torque element for absorbing shear forces in a screw connection, wherein each torque element has a first side and an elevation, wherein the elevation protrudes from the first side, wherein the elevation has a base contour and a smaller top contour so that between the base contour and the top contour, at least one sloping face is provided, wherein the elevation has a height axis at a center of the elevation, the height axis being perpendicular to the base contour, wherein the elevation is arranged for positioning in a corresponding cut-out in the first bucket element to engage with the first bucket element, wherein the elevation is arranged to receive the screw connection along the height axis for the torque element to be attached to the first bucket element, wherein either the torque element or the first bucket element has an internally threaded portion for the screw connection, the torque element connecting the first bucket element with a second bucket element of the at least two bucket elements, and wherein a clearance is formed between a top face of the elevation and a bottom contour of the cut-out when the elevation is positioned in the cut-out.

* * * * *